US006018849A

United States Patent [19]

Royer

[11] Patent Number: 6,018,849

[45] Date of Patent: Feb. 1, 2000

[54] PAPER CLIP

[76] Inventor: George R. Royer, 2137 Ragan Woods Dr., Toledo, Ohio 43614

[21] Appl. No.: 09/197,553

[22] Filed: Nov. 23, 1998

[51] Int. Cl.[7] ..... A44B 21/00; A42F 1/00

[52] U.S. Cl. ..... 24/67 CF; 24/67 R; 24/67.3; 24/67.9

[58] Field of Search ..... 24/67 CF, 67.9, 24/67.3, 67 R

[56] References Cited

U.S. PATENT DOCUMENTS

| | | | |
|---|---|---|---|
| 487,959 | 12/1892 | McDonald | 24/67.9 |
| 524,647 | 8/1894 | Pancoast | 24/67 CF |
| 648,841 | 5/1900 | Brosnan . | |
| 1,110,906 | 9/1914 | Deal | 24/67.9 |
| 1,482,341 | 1/1924 | Arnold | 24/67 R |
| 1,637,485 | 8/1927 | Hiering | 24/67.9 |
| 5,255,458 | 10/1993 | Piel | 24/67 CF |

FOREIGN PATENT DOCUMENTS

| | | | |
|---|---|---|---|
| 0349396 | 5/1905 | France | 24/67 CF |

*Primary Examiner*—Victor N. Sakran

[57] ABSTRACT

The subject invention is an improved paper clip member that comprises a back member having at least two edges that are disposed at substantially a right angle to one another, said back member having an extension member extending from a portion thereof that is structured to be the upper member that is placed in a clasping manner over the front or upper surface of the grouped papers with the back member placed against the back surface of the grouped papers, with the two perpendicular edges adapted to brace the adjoining perpendicular side edges of the grouped papers.

3 Claims, 2 Drawing Sheets

PAPER CLIP

DESCRIPTION OF PRIOR MATERIAL AND BACKGROUND OF INVENTION

The subject invention relates to devices that are used to affix a group of papers together in a unitary manner. The purpose of such devices is to hold together a group of otherwise loose papers, and many such devices have been conceived for this purpose.

Common types of such fastening devices include the well known paper clip and staples. Paper clips, in all their varied forms, function to hold individual papers together as a temporary detachment device which can be readily removed. Staples, on the other hand, are more of a semi-permanent device to affix loose papers in a more secure manner. In order to separate papers or documents affixed together by a staple, more effort is needed to pull the staple from the papers because of its secure alignment.

Disadvantages exist in paper clip designs, as well as with staples. For example, paper clips do not have the capability of keeping the group of papers aligned evenly along the top and side surfaces, as the securing mechanism does not have structured means to provide such alignment. While stapled members can hold papers in a previously established alignment of papers, the problem of removing a staple are prevalent. This aspect is coupled with the fact that staples make holes in the paper once removed.

In view of the existing difficulties and shortcomings of the existing paper attachment devices the invention herein is conceived accordingly, as briefly discussed above, the following objects of the subject invention are described accordingly.

OBJECTS

The following are objects of the subject invention.

It is an object of the subject invention to provide an improved paper attachment device, and another object of the subject invention is to provide an improved device for grasping together otherwise loose papers in a manner so that the sides and top edges of paper members are substantially aligned and even with one another;

Another object of the subject invention is to provide an improved method for securing papers together;

It is also an object of the subject invention to provide an improved paper clip;

Other and further objects of the subject invention will become apparent from a reading of the following description taken in conjunction with the claims.

DRAWINGS

DISCUSSION OF GENERAL EMBODIMENT OF THE SUBJECT INVENTION

Figure 1:
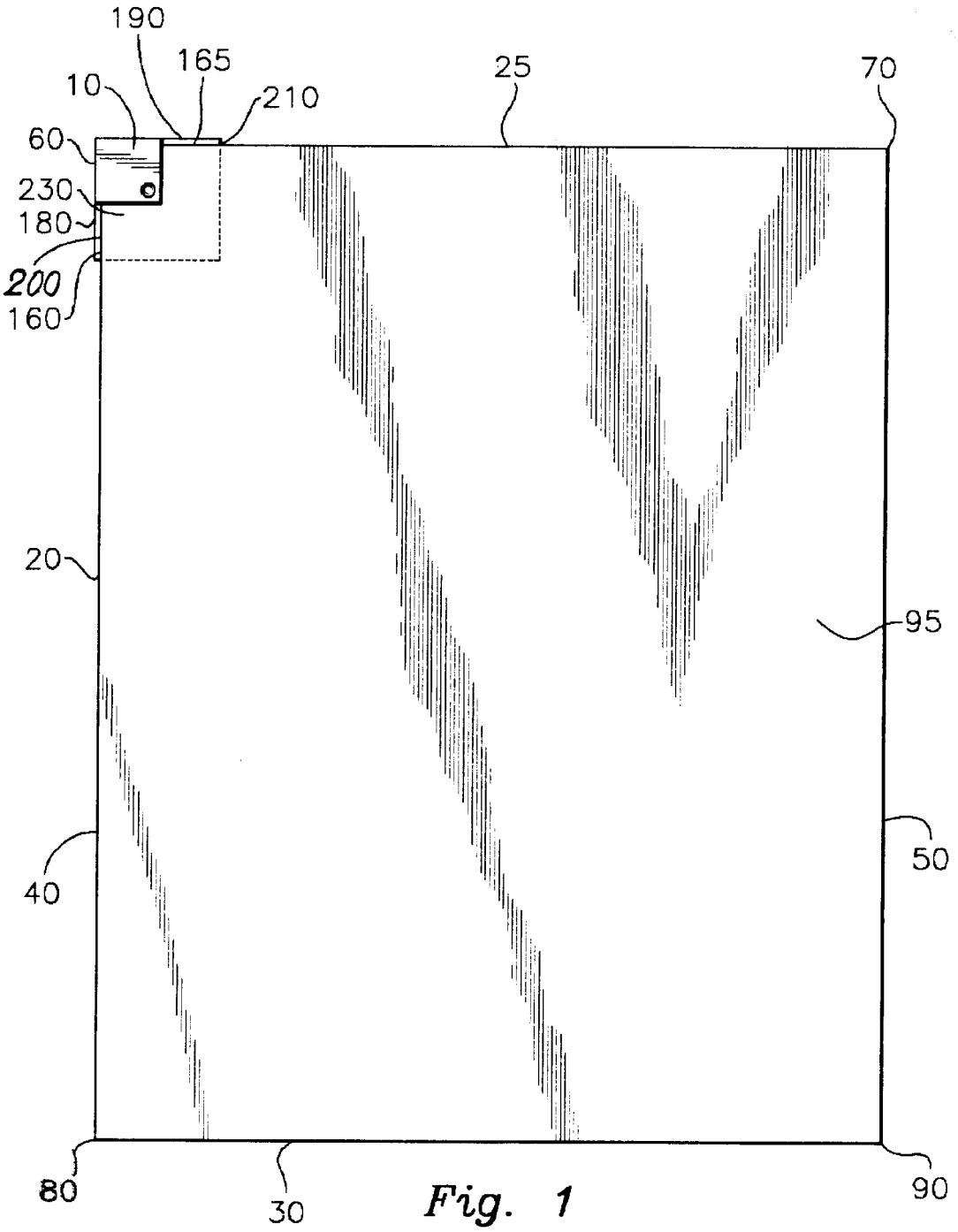
FIG. 1 is a top elevational view of a top sheet of a group of attached paper members showing one embodiment of the subject invention.

The subject invention is a paper grasping member, designed to hold a group of papers together in an aligned, unitary member comprising in general:

(a) a back support member having means to hold together in an aligned manner a portion of adjoining side edges and top edges of a group of aligned papers, said back support member adapted to engage in a flush manner a portion of the back surface of the last sheet in the group of papers as well as a portion of adjoining side edges and the top edges of the group of papers.

(b) an upper clasping member adapted to be flexibly mounted to a portion of the back support member and wherein the upper clasping member is adapted to press against, in a clasping manner, the upper surface of the top sheet of the group of papers.

DESCRIPTION OF PREFERRED EMBODIMENT

In describing the preferred embodiment of the subject invention, it is to be stressed that such description is of only one embodiment, and that the scope of the subject invention is set forth in the claims is not to be limited by such description of only one embodiment.

Referring to the drawings in which a preferred embodiment is shown, a paper clasping member 10 is shown as incorporating features of the subject invention. Paper clasping member is adapted and structured to hold together a group of paper, each paper 20 having upper corners that are uniformly square, such as an upper corner, whether left or right corner, which is formed with the adjoining edges being mutually perpendicular to one another. Such right-angled corners are conventional for standard paper. This invention is conceived as a means to join a group of papers with such square corners into a uniformly aligned packet, which will remain so aligned. The following is a description of such a preferred embodiment.

Figure 2:
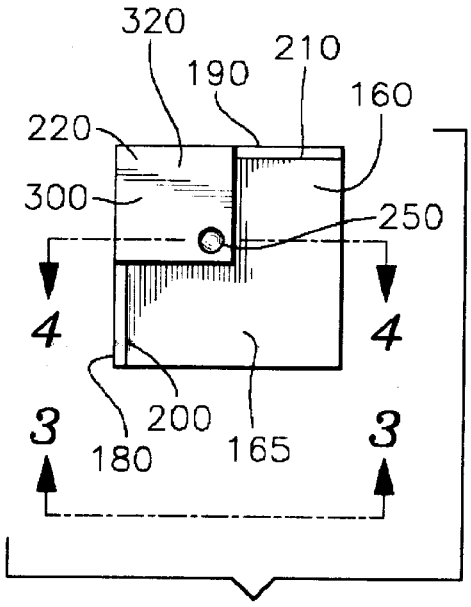
FIG. 2 is a top elevational view of the subject invention showing the preferred embodiment of the subject invention.

Referring to FIG. 2 in which paper sheet 20 is shown as being representative of the type of cut paper to which the subject invention applies. However, no inventive concept applies to the paper as such, and representation of a piece of paper is shown and described for background purposes only in order to explain how the subject invention applies. Specifically, such paper sheet 20 is a conventional rectangular piece of paper that has a top edge 25 and a bottom edge 30, along with left side edge 40 and right side edge 50. As seen, such paper sheet 20 has a top left corner 60 and a top right corner 70. Moreover, paper sheet 20 has a bottom left corner 80 and a bottom right corner 90. Paper sheet 20 has a frontal surface and a back surface within the limits of the respective edges just described. Each such corner 60, 70, 80 and 90 represented in FIG. 1 is square, or more specifically, the side edges forming each such corner are mutually perpendicular to one another such that the adjoining edges form a ninety-degree angle. For example, top left corner 60 is formed by the intersection in a ninety-degree angle, of top edge 20 and left side edge 40. These angular relationships of the adjoining edges forming square corners is conventional.

The device, which incorporates features of the subject invention, is adapted to hold together in an aligned manner, a plurality of pieces of paper, such as paper sheet 20. The device involved is adapted to be clipped to portions of one or more of respective corners and portions of adjoining side edges so that the resulting corner of such aligned group of papers is clasped by the subject device as well as a portion of each paper sheet that is next or otherwise adjacent to the corner so clasped.

Figure 3:
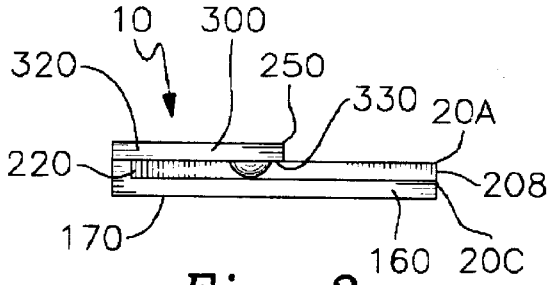
FIG. 3 is a side elevational view in cross-section along line A—A of the embodiment shown in FIG. 2.
Figure 4:
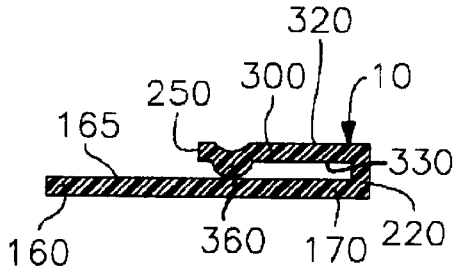
FIG. 4 is a cross-sectional view, as shown, of the preferred embodiment.
Figure 6:
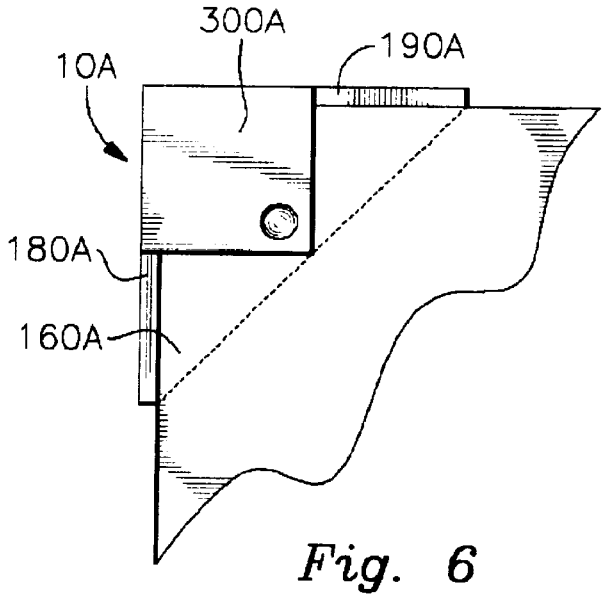
FIG. 6 is a top elevational view of an alternate embodiment of the subject invention.

In particular, the clasping device 10 that incorporates features of the invention herein is shown in FIGS. 1, 3 and 4, and in the preferable embodiment is comprised of a flexible material, such as, pliable or hard plastic, or other similar material. Moreover, the material forming the subject device may be clear or opaque clasping device 10 is basically a planar member having a back portion 160, which is shown as being a rectangular-shaped member, as seen from a top or bottom elevational view represented in FIG. 3. The rectangular shape represented in FIG. 3 is not a critical shape for such back portion 160 and may be formed or configured in other than a rectangular or square configuration, so long as it has some breadth and length, however, irregular or regular in shape, and is sufficient to embrace a portion of the pack pages adjacent to the corner section of the stack of papers over which the subject device is placed. In one embodiment shown in FIG. 6 the backing member is shaped as a triangular member as seen from an upper elevational view.

The back portion 160 of the backing device forms the basic structural foundation for the clasping device 10, as all other portions of the clasping device 10 are formed as appendages to such back portion, as can be seen in the drawings. As seen in the drawings, the backing member has an upper surface 165 and a lower surface 170.

In the preferred embodiment, while it is not critical to the subject invention, upper surface 165 of the back member 160 has at least two side edges 180 and 190 that are mutually perpendicular to one another. Each side edge 180 and 190 is raised upwardly outwardly from the portions of the upper surface 165 of the backing member, such that side edges 180 and 190 extend beyond the planar surface of the upper surface of the backing member 160 as seen. In the preferred embodiment of the subject invention, each side edge has an inner vertical, flat surface 200 and 210 respectively, and these inner surfaces should be straight and flat. It is preferable that the resultant construction of the backing member 160 with its raised side edges 180 and 190, is such that the inner surface 200 of side edge 180 be aligned along a planar disposition that is perpendicular to the plane of the upper surface of 165 of backing member 160, and similarly that the inner surface 210 of side edge 190 be perpendicular also to the plane of such upper surface 165. In the preferred embodiment of the subject invention, it is contemplated that inner side surface 200 of side edge 180 be aligned at right angles to the inner side surface 210 of side edge 190. It is not essential that the inner side surface 200 be joined to the inner side surface 210, however, in the preferred embodiment such a joinder is optimal. Moreover, the inner surface 200 of side edge 180 and inner surface 210 of side edge 190 may be of any desired length so long as their respective planes intersect in an apex, whether imaginary extended or with actual contact.

As can be seen, an apex corner 220 is formed by the inner surface 200 and inner surface 210 may actively meet to form such apex corner. In the preferred embodiment of the subject invention, the raised inner surfaces 200 and 210 of the side edges 180 and 190 respectively are preferably, but necessarily perpendicular to the upper surface 165 of the backing member 160 as stated. These raised inner surfaces of 200 and 210 of the respective side edges 180 and 190 thus function and serve as side brace members disposed in such perpendicular manner to hold the adjoining edges of paper sheets in place within a squared cornered confine for common alignment as seen in FIG. 1. In the preferred embodiment, these raised inner surfaces 200 and 210 meet and may be joined forming corner apex 220 of the backing member. It is not essential to working of the subject invention that these brace members be joined together so long as they extend generally or substantially perpendicular to the upper surface of the backing member 160 along some portion of the perpendicular side edges 180 and 190 of the backing member 160 as discussed as seen in the drawings. Moreover, these side edges need not be raised in alternate arrangements of the subject invention.

As can be seen the backing member 160, with the raised inner surfaces 200 and 210 form an apex corner portion 220 is thus adapted to receive the resultant corner portion 230 of a group of paper sheets, such as paper sheet 20 as seen in FIG. 1, wherein the adjoining perpendicular sides, such as side edge 40 and top edge 25 of the individual paper sheets 20A, 20B, 20C etc. can be placed in such grouped manner flush and precisely against the inner surface 200 and 210 respectively of side edges 180 and 190.

More precisely, when the resultant upper left corner portion 230, for example, of the aligned group of paper sheets 20A, 20B 20C . . . are placed over the upper surface 165 of the back member the respective left side edge 40 is braced straight and flush against the inner surface 200 while the resultant top side edge 25 is braced squarely against the inner side edge 210, so that the resultant corner apex 230 of the grasped papers if firmly embraced against and within the right angle apex corner 230 formed by such inner surfaces 200 and 210. This latter structural aspect is the main feature of the subject invention that keeps the resultant papers aligned on both top and both side edges to one another in the right angled relationship.

Moreover, as seen in the drawings, integrally joined at near the apex corner 220 of the backing member is a flexible clip member 300. In the preferred embodiment of the subject invention, flexible clip member 300 may be joined to any portion of the backing member 160 and may be formed as a rectangular piece having an upper planar 320 surface and a lower planar surface 330. The flexible clip can, however, be shaped in any desirable configuration, so long as the portion appended to the portion of the backing member can be pulled upwardly on the end 250 which is distal from the apex corner 220 in a flexible manner so that the paper sheets, as grouped, can be inserted in part over the upper surface 165 of the backing member 160 and under the lower surface 330 of he clip member 300, as shown in the drawings and particularly FIG. 3. In brief, the flexible clip 300 is structured to fit over the top paper sheet 20A of the group of papers to press the grouped paper sheets downwardly towards the upper surface 165 of backing member 160 as seen. This is the clasping function to hold the paper sheets together. In the preferred embodiment, the clip member is preferably, but not essentially affixed near the apical corner 220 of the backing member 160, as seen in the drawings, with the flexible portion of the clip member being located at such joinder portions. It is noted that the clasping device is to be lifted on its distal end 250, which is the end of the clip most distal from the portion where it is joined to the back member 160, and this distal end is raised upwardly to permit paper sheets to be place, in part, between the upper surface 165 of back member and the lower surface 330 of the clip member 300 as seen.

Figure 5:
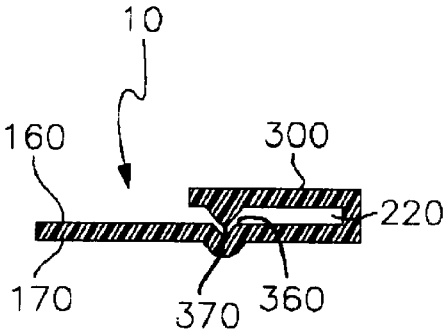
FIG. 5 is a cross-sectional view of the subject invention.

In some embodiments as seen in FIGS. 4 and 5, the clip member may have a knob 360 on its lower surface extending downwardly to help grasp and press the paper sheets against the backing member 160, and is seen in FIG. 5 the knob 360 may be formed and to depress into a corresponding depression 370 in the upper surface 165 of backing member 160.

In summary, the subject device incorporating subject invention is a device for grasping and holding together a group of papers at a corner portion of said group of papers comprising:

a) a base member having an upper surface and a lower surface, such upper surface of such backing member being a planer member with such base member having a first raised side edge and a second raised side edge on the upper surface of such backing member, such first and second side edge bearing mutually perpendicular to one another;

b) clasping means affixed to a portion of the base backing member, such clasping member having an upper surface and lower surface, with a portion of the lower surface of the backing member being disposed over a portion of the upper surface of the backing member.

Further summarizing, the subject invention is a paper clasping member adapted to clasp together a group of papers such that the side and top edges of the individual papers comprising the group of papers are aligned along such side and top edges, such clasping member comprising:

a) a base backing member having a first surface and a second surface opposing one another, with such backing member having on such first surface a first raised edge and a second raised edge, both such edges being disposed with such first raised edge and such second raised edge being perpendicular to one another, with such first raised edge and such second raised edge forming by such perpendicular relationship an apical spatial area to conformingly receive a corner portion of such group of papers;

(b) paper clasping means affixed to a portion of such backing member, such clasping member having flexible means to impinge a part of such clasping means against a portion of such group of papers as conformingly received in the apical spatial area of such backing member.

Yet another summary of the subject invention is a paper clasping member adapted to clasp together a group of papers such that the side and top edges of the individual papers comprising the group of papers are aligned along such side and top edges, such clasping member comprising:

(a) a base backing member having a first surface and a second surface opposing one another with such backing member having on such first surface a first raised edge and a second raised edge, with such first raised edge and such second raised edge being perpendicular to one another, with such first raised edge and such second raised edge forming by such perpendicular relationship an apical spatial area to conformingly receive a corner portion of such group of papers;

(b) paper clasping means affixed a portion of such backing member, such clasping member having flexible means to restrict and alternately impinge against a portion of such group of papers as conformingly received in such apical spatial area formed by such first raised edge and such second raised edge on such backing member.

I claim:

1. A device for grasping and holding together a group of papers comprising:

a) a base backing member having an upper surface and a lower surface, said upper surface being a flat, planar member, said base member having at least a first side edge and a second side edge that are mutually perpendicular to one another, said base member having a first raised linear extending raised portion disposed parallel to said first side edge and a second linear extending raised portion disposed parallel to said second side edge said first and second raised portions being disposed perpendicular to one another.

b) clasping means affixed to a portion of the base member, said clasping member having an upper surface and lower surface, said clasping means comprising a piece member affixed to a portion of said backing member.

2. A paper clip member adapted to clasp together a group of papers such that the side and top edges of the individual papers comprising the group are aligned along such side and top edges such clip member comprising:

(a) a base backing member having an upper surface and a lower surface, with said backing member having at least a first edge and a second edge disposed between the upper surface and the lower surface, with said first edge and second edge being perpendicular to one another with such first edge and second edge having a vertical extension portion extending upwardly beyond the upper surface of said backing means, with each such vertical extension portion having an inner surface that is straight and aligned parallel to the respective edge to which it is joined;

(b) means to clasp papers against the base backing member, said means comprising a one piece flexible member having an upper surface and a lower surface, said means affixed to a portion of the backing member and wherein said clasping member as downwardly protruding means in the lower surface to impinge against said papers.

3. A paper clasping member adapted to clasp together a group of papers such that the side and top edges of the individual papers comprising the group of papers are aligned along such side and top edges, such clasping member comprising:

(a) a base backing member having a first surface and a second surface opposing one another with said backing member having on said first surface a first raised edge and a second raised edge, with said first raised edge and said second raised edge being perpendicular to one another, with said first raised edge and said second raised edge forming by such perpendicular relationship an apical spatial area to conformingly receive a corner portion of said group of papers;

(b) paper clasping means affixed a portion of said backing member, said clasping member having flexible means to restrict and alternately impinge against a portion of said group of papers as conformingly received in said apical spatial area formed by said first raised edge and said second raised edge on said backing member.

* * * * *